US005230657A

United States Patent [19]

Opoka

[11] Patent Number: 5,230,657

[45] Date of Patent: Jul. 27, 1993

[54] AIR REGISTER COVER CONSTRUCTION

[76] Inventor: Larry D. Opoka, 805 NE. 190th St., Portland, Oreg. 97230

[21] Appl. No.: 882,732

[22] Filed: May 14, 1992

[51] Int. Cl.[5] ..... F24F 13/10

[52] U.S. Cl. ..... 454/289; 454/259; 454/307

[58] Field of Search ..... 454/218, 259, 289, 290, 454/307

[56] References Cited

U.S. PATENT DOCUMENTS

| | | | |
|---|---|---|---|
| 848,758 | 4/1907 | Meibeyer | 454/290 |
| 1,022,870 | 4/1912 | Power | 454/218 |
| 1,843,243 | 2/1932 | Rose . | |
| 1,975,686 | 10/1934 | Froelich | 454/307 |
| 3,738,254 | 6/1973 | Root . | |
| 4,394,958 | 7/1983 | Whitney et al. . | |
| 4,457,215 | 7/1984 | Vogt | 454/307 X |
| 4,850,266 | 7/1989 | Bennett . | |

*Primary Examiner*—Harold Joyce
*Attorney, Agent, or Firm*—Henderson & Sturm

[57] ABSTRACT

A collapsible lightweight cover device (10) for floor registers (100) including a cover member (20) pivotally secured to the register (100) and having accordion folded panel members (30) operatively attached to both the cover member (20) and the register (100); wherein, forced air flowing through the register (100) will force the cover member (20) to pivot upwardly relative to the front of the register (100).

1 Claim, 1 Drawing Sheet

AIR REGISTER COVER CONSTRUCTION

TECHNICAL FIELD

The present invention relates to the field of air registers in general, and in particular to a collapsible air register cover construction which saves energy due to the fact that it is only open when air is being forced through the register.

BACKGROUND ART

As can be seen by reference to the following U.S. Pat. Nos. 4,394,958; 3,738,254; 1,843,243; and 4,850,266; the prior art is replete with myriad and diverse condition responsive air register constructions.

While all of the aforementioned prior art constructions are more than adequate for the basic purpose and function for which they have been specifically designed, these patented constructions are neither designed nor intended to fulfil the role that is provided by the subject matter of the present invention; in that the prior art devices are either recessed wall mounted arrangements or floor registers that project a substantial distance above the level of the surrounding area.

While all of the devices are energy savers given the fact that they are condition responsive dampers, the floor registers in particular present unique problems in that they create obstructions for both pedestrians and furniture depending upon their placement; as well as serving as dirt and dust traps around their raised peripheries which are not easily accessible to most vacuum cleaners.

DISCLOSURE OF THE INVENTION

Briefly stated, the collapsible air register cover construction that forms the basis of the present invention provides a low profile or even recessed air register cover that will not only support the weight of a person walking over the vent and allow the area surrounding the vent to be vacuumed in the normal manner; but, which will also provide an aesthetically pleasing appearance to the covered vent, as well as producing energy savings since the register cover is biased closed by gravity; and, will only assume its open disposition under the influence of forced air issuing from the air register.

As will be explained in greater detail further on in the specification, the air register cover construction of this invention comprises a generally rectangular cover member having pleated accordion sides which allows the cover member to pivot relative to one end of an air register; such that the flow of forced air through the register will lift the cover member, and direct the flow of air out of the register in a generally horizontal direction.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
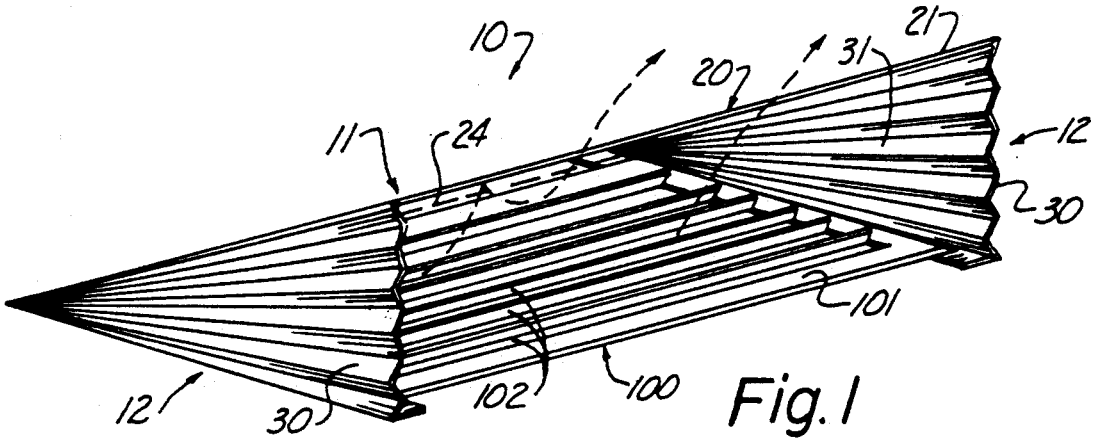
FIG. 1 is a perspective view of the collapsible air register cover construction that forms the basis of the present invention.
Figure 2:
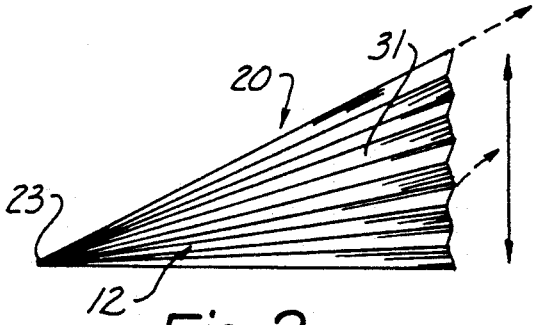
FIG. 2 is a side elevation view of the air register cover in its open disposition.

As can be seen by reference to the drawings, and in particular to FIG. 1, the collapsible air register cover construction that forms the basis of the present invention is designated generally by the reference numeral (10).

The cover construction (10) comprises in general a cover unit (11) provided with a pair of pleated side panel units (12). These units will now be described in seriatim fashion.

As shown in FIG. 1, the cover construction (10) that is the subject matter of this invention is designed specifically for use with a floor mounted air register (100) having a central grill element (101) provided with a plurality of conventional air register openings (102).

Figure 3:
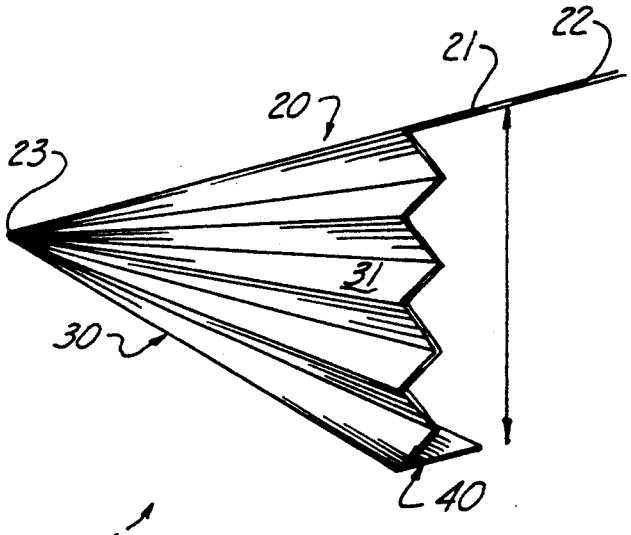
FIG. 3 is an enlarged detail of one of the side panel units.
Figure 4:
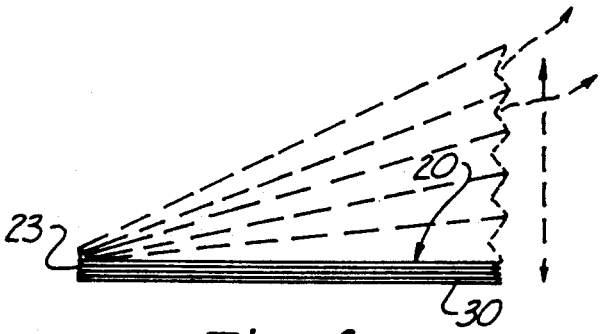
FIG. 4 is a side elevation view of the air register cover in its closed disposition.

As can best be seen by reference to FIGS. 1 and 3, the cover unit (11) comprises a generally thin flat rectangular cover member (20) fabricated from a sheet (21) of lightweight, generally rigid yet flexible material (22) such as space age plastics, or the like.

In addition each of the pair of pleated side panel units (12) comprise accordion folded side panel members (30) which depend downwardly from the opposite side of the cover member (20); wherein, in the preferred embodiment of the invention the side panel members (30) are fabricated from a super lightweight material (31) such as mylar, or the like; whose combined weight will only be a small fraction of the weight of the cover member (20) for reasons that will be explained presently.

As can be appreciated in particular by reference to FIG. 3, the bottom portion of the side panel members (30) are provided with securing means (40) such as adhesive strips, or the like to engage the bottoms of the panel members (30) to the opposite sides of the air register (100).

In addition, the rear edge (23) of the cover member (20) may be provided with a hinged flap (24) depicted in phantom in FIG. 1; wherein, the hinged flap (24) is also provided with securing means (40) for pivotally attaching the rear edge (23) of the cover member (20) to the back of the air register (100).

In this manner the collapsible air register cover device (10) will assume a normally closed position; wherein, the cover member (20) is disposed in a virtually flush relationship with the air register grate (101) in the absence of forced air flowing through the register (100) due to the minimal thickness provided by the side panel members (30). In addition the cover member (20) will have sufficient rigidity and durability, despite its lightweight, to allow a person to walk on the air register; as well as providing such a low profile that a vacuum cleaner can easily pass over the device (10) to remove debris deposited on and around the device (10).

However, once air is forced through the air register the lightweight cover member (20) and the super lightweight side panel members (30) will cooperate to not only allow the cover member (20) to be pivoted upwardly relative to the air register (100); but, to direct the forced air in a generally horizontally directed pattern through the opening defined by the front edges of the cover member (20) the side panel members (30) and the register (100).

It should also be appreciated at this juncture that the device (10) of this invention can be manufactured in a variety of colors to complement the decor of the areas in which it is installed; and, even if the device (10) is only produced in neutral colors, its clean lines and flat profile will still produce an aesthetically pleasing effect for the user; while the device is still producing the desired operating characteristics inherent in its unique design.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A collapsible air register cover device in combination with a floor register; wherein, the device consists of:

a generally thin flat rectangular cover member pivotally secured on one end to the rear of said floor register; and, a pair of accordion folded side panel members depending downwardly from the opposite sides of the cover member; wherein, the bottoms of the panel members are secured to the sides of the floor register; wherein, the flow of forced air through said register is sufficient to overcome the combined weight of the cover member and the panel members to lift the front end of the cover member from engagement with floor register; wherein, the combined weight of the panel members represent a fraction of the weight of the cover member.

* * * * *